US008177068B2

(12) United States Patent
Dias

(10) Patent No.: US 8,177,068 B2
(45) Date of Patent: May 15, 2012

(54) PACKAGING AND DISPLAY BOX

(75) Inventor: Rodrigue Dias, Worms (DE)

(73) Assignee: Reckitt Benckiser N.V., Hoofddorp (NL)

( * ) Notice: Subject to any disclaimer, the term of this patent is extended or adjusted under 35 U.S.C. 154(b) by 690 days.

(21) Appl. No.: 11/718,185

(22) PCT Filed: Oct. 19, 2005
(Under 37 CFR 1.47)

(86) PCT No.: PCT/GB2005/004013
§ 371 (c)(1),
(2), (4) Date: Oct. 28, 2009

(87) PCT Pub. No.: WO2006/046005
PCT Pub. Date: May 4, 2006

(65) Prior Publication Data

US 2011/0017813 A1 Jan. 27, 2011

(30) Foreign Application Priority Data

Oct. 27, 2004 (GB) ..... 0423805.1

(51) Int. Cl.
*B65D 25/00* (2006.01)

(52) U.S. Cl. ..... 206/774; 229/240; 229/243

(58) Field of Classification Search ..... 206/192, 206/736, 774; 229/122, 243, 125.32, 240
See application file for complete search history.

(56) References Cited

U.S. PATENT DOCUMENTS

| | | | | |
|---|---|---|---|---|
| 3,276,666 | A * | 10/1966 | Johnson | 229/235 |
| 3,315,874 | A * | 4/1967 | Buttery | 229/227 |
| 5,443,205 | A * | 8/1995 | Robotham et al. | 229/243 |
| 5,555,982 | A * | 9/1996 | Kuhn et al. | 206/746 |
| 5,657,872 | A * | 8/1997 | Leftwich et al. | 206/738 |
| 5,803,348 | A * | 9/1998 | Verhelle | 229/125.08 |
| 116,613 | A1 | 6/2003 | McLeod et al. | |
| 6,932,265 | B2 * | 8/2005 | Sax et al. | 229/122 |
| 2005/0184139 | A1 * | 8/2005 | Gasior | 229/240 |

FOREIGN PATENT DOCUMENTS

EP 0442179 A1 2/1990

* cited by examiner

*Primary Examiner* — David Fidei
(74) *Attorney, Agent, or Firm* — Norris McLaughlin & Marcus PA

(57) ABSTRACT

A packaging and display box (1). The box (1) has a base (2) with a retaining wall (4) adjacent a section of its perimeter. The wall is for retaining a primary package. The box has a lid (3) which extends between two portions of the base. The lid (3) covers at least a part of the primary package. The lid (3) is attached to the retaining perimeter wall such that removal of the lid from the package causes detachment of the perimeter wall from the base.

13 Claims, 3 Drawing Sheets

PACKAGING AND DISPLAY BOX

Figure 1B:
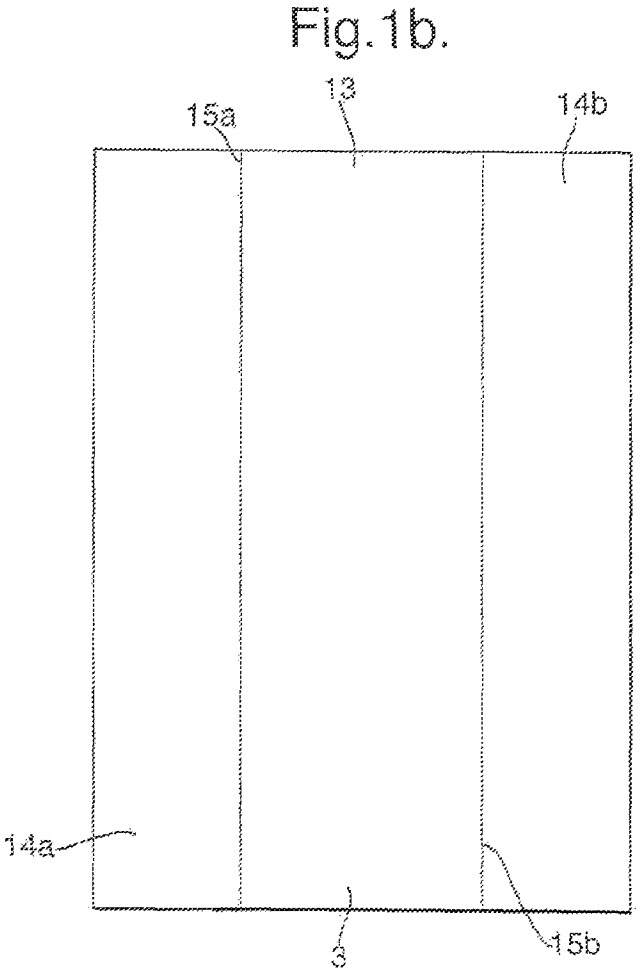

This is an application filed under 35 USC 371 of PCT/GB2005/004013.

The present invention relates to packaging and displaying box.

Packaging boxes are extremely commonplace. One of the main purposes of packaging boxes (by which it is intended to refer to secondary packaging boxes) is to accommodate primary packages containing a consumer product. The secondary packaging boxes provided an easy way of holding/protecting multiple primary packages between the point of manufacture and the point of retail to a consumer. The secondary packaging boxes may be used on, for example, a supermarket/shop shelf as a retention/display aid for a product.

Normally the secondary packaging boxes have a simple construction and comprise a sheet of folded card or cardboard. The sheet is assembled into the desired shape (by folding) before being filled with the primary packages.

The boxes typically comprise a base having a peripheral wall and a removable lid. When the lid is removed the peripheral wall is high enough to retain the primary packages and to allow the secondary package to be moved without loss of its contents, yet the peripheral wall is low enough for a consumer to see the primary packages contained in the secondary packaging and to remove them therefrom.

Whilst the peripheral wall is a useful retention aid its presence is also disadvantageous, as clearly a portion of the primary package is obscured by the peripheral wall when present in the secondary packaging.

This can be particularly detrimental as an important part of the primary package can be obscured. The obscured part of the primary package may, for example, comprise an significant warning for a consumer or a beneficial notice such as 'money-off' indication.

To compound this issue there is ever increasing pressure on manufacturers to make their primary packaging ever more appealing/eye catching to a consumer whilst at the same time complying with changing safety legislation. Normally it is not possible to have a 'blank' part of a primary package which can be obscured by a retaining wall.

Additionally secondary packaging may vary from country to country, meaning that for a product sold in more than one jurisdiction the primary package would have to be altered to take into account local variations in the secondary packaging.

Whilst manufacturers are aware that the presence of this peripheral wall is problematic, this issue cannot easily be addressed.

It is an object of the present invention to obviate/mitigate the issues outlined above.

According to the present invention there is provided a packaging and display box, the box having a base with a retaining wall adjacent a section of its perimeter for retaining a primary package and a lid which extends between two portions of the base, the lid covering at least a part of the primary package, wherein the lid is attached to the retaining perimeter wall such that removal of the lid from the package causes detachment of the perimeter wall from the base.

It has been found that the packaging and display box of the present invention has excellent properties.

Firstly as the retaining wall is removed with the removal of the lid, the packaging and display box, in use, allows clear display of the entire surface of a primary package contained therein. Thus no labelling or graphics printed on the surface are obscured by the retaining wall. This makes a selection of the primary package by a consumer less ambiguous and more safe.

Secondly as the retaining wall is removed in a single operation with the lid there is no need for a second step to remove the retaining wall. This removes the need for a potentially dangerous cutting/tearing operation performed on the perimeter wall. Additionally this removes the potential for damage caused to the primary packaging in such a secondary removal step.

Preferably the perimeter wall removed from the base is disposed along an edge of the base which is intended to face a consumer, when the box is placed on, for example, a supermarket shelf. Removal of this wall improves visibility of the primary packaging in the box.

The base preferably has an additional retained perimeter wall extending around the remainder of the perimeter of the base. By remainder it will be clearly understood that the term remainder is intended to refer to the less prominent sides/faces of the displaying box, i.e. those sides/faces which are not intended to be viewed directly by a consumer when the displaying box is placed in a display position. The additional retaining wall is not intended to be removed on removal of the lid; it is intended to remain in place and provide a retention function for the box.

Generally the base of the box is formed from a sheet of material such as a sheet of card, thickened paper or cardboard.

Usually the perimeter wall is formed by folding the edge of the sheet inwards.

The removable perimeter wall is preferably formed by folding as above. To facilitate removal of the removable perimeter wall the fold between the wall and the base is preferably weakened. Preferred methods of weakening include scoring and cutting along the fold. Most preferably the fold between the base and the removable perimeter wall is cut along the majority of its length for ease of removal. To ensure that the removable perimeter wall adheres to the base before removal a portion of the fold, preferably adjacent the terminii of the fold remains in place.

The removable perimeter wall is attached to the lid. The attachment may be direct, i.e. a portion of the wall may be attached to a portion of the lid. Alternatively the attachment may be indirect, i.e. one or more of the removable perimeter wall and/or the lid has an appendage (e.g. such as a flap) which can be used for attachment. Most preferably the removable perimeter wall has a flap for this purpose. The flap may be adhered to the lid by gluing (with an adhesive) or may be physically bonded to the lid, e.g. by retention of the flat in a receiving aperture of the lid. Most preferably the flap is glued to the lid.

Generally the flap from the removable peripheral wall extends from an edge of the wall. Most preferably the flap extends from a side edge, so that the flap may be folded about a vertical fold towards the box. Normally the removable peripheral wall comprises two flaps, with one disposed at each side edge.

It is preferred that the lid extends along the length of the box to offer protection for the primary packages in the box. Preferably the lid comprises a sheet of folded material, e.g. card as above. Generally the lid is in the form of a plane with a pair of dependent curtains (formed by folding, running along opposite edges of the plane). The lower edges of the curtains are intended to extend such that they are adjacent to the retained peripheral walls of the box, thus covering the primary packages.

The curtains are preferably attached to the box at/by the flaps of the removable peripheral wall, as described above.

Generally the packaging and displaying box of the present invention is intended to be used to hold primary packages in the form of rectangular boxes. Clearly the boxes may be used to hold a variety of consumer products. One preferred product is a detergent, in the form of, for example, a powder, tablet or soluble capsules.

In use the packaging and displaying box is placed in the desired locus and the lid is gripped and removed in a pulling action. In removing the lid the removable perimeter wall is separated from the base of the box and the contents of the box (the primary packages) become clearly visible.

Figure 1A:
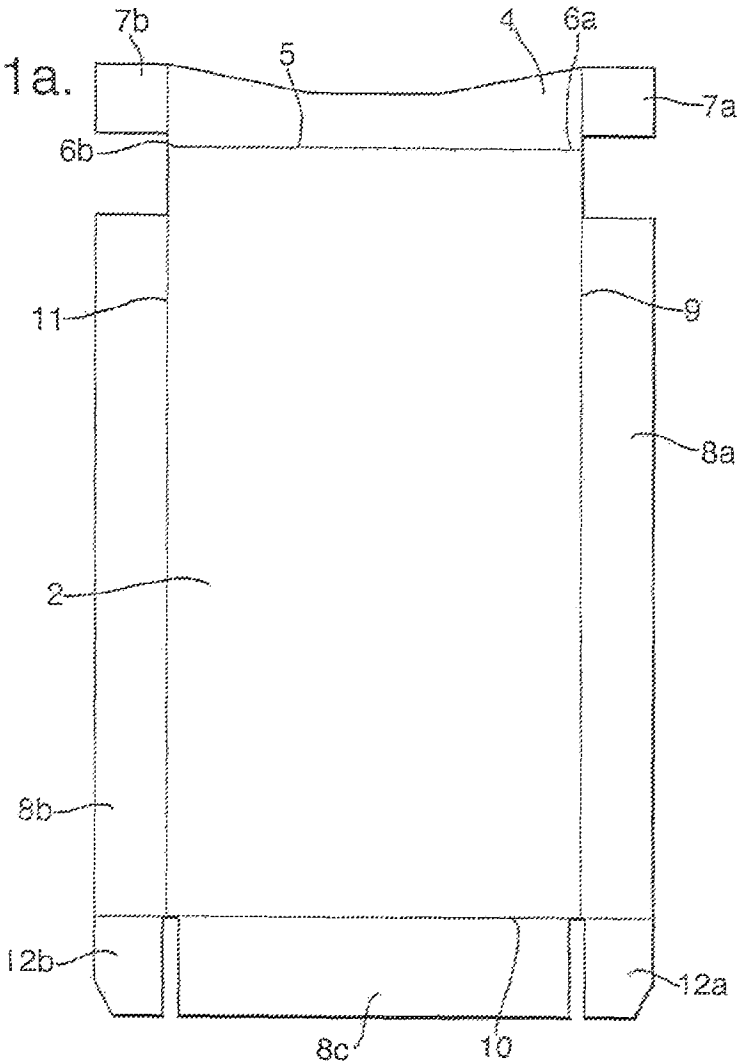
Figure 2:
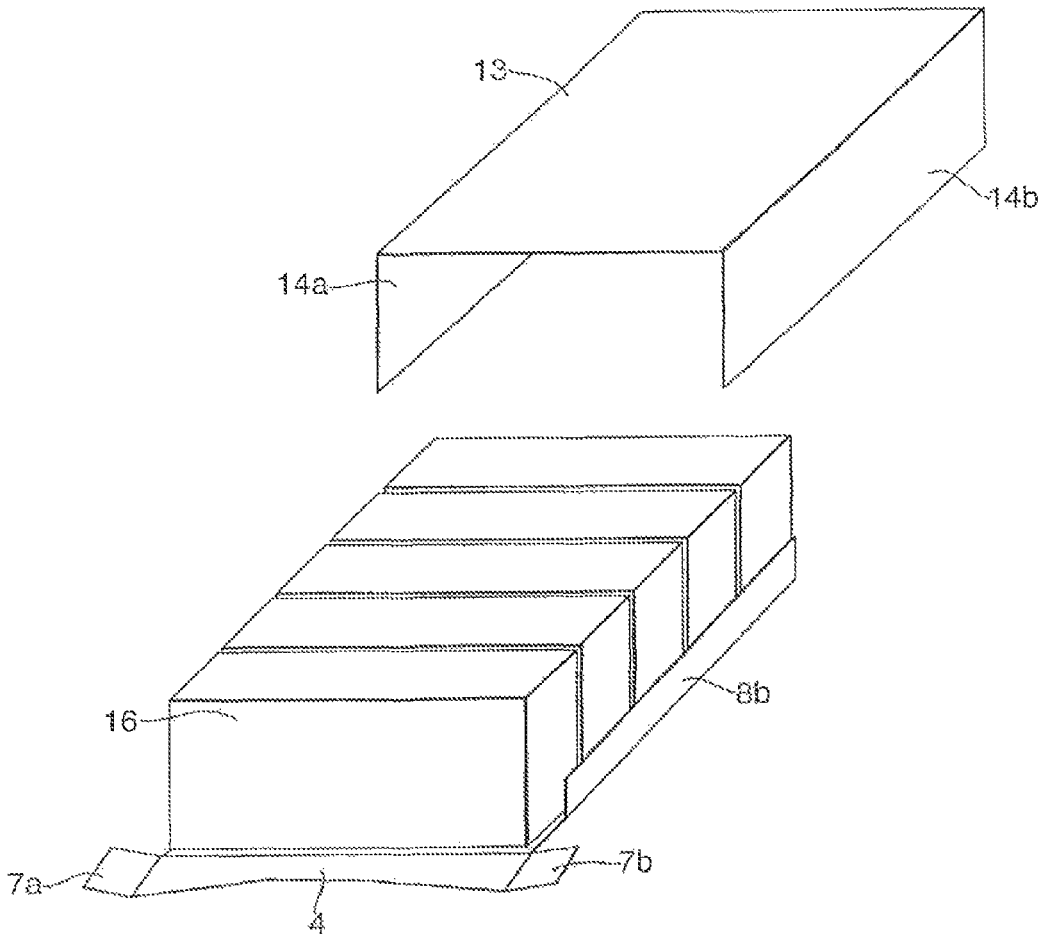
Figure 3:
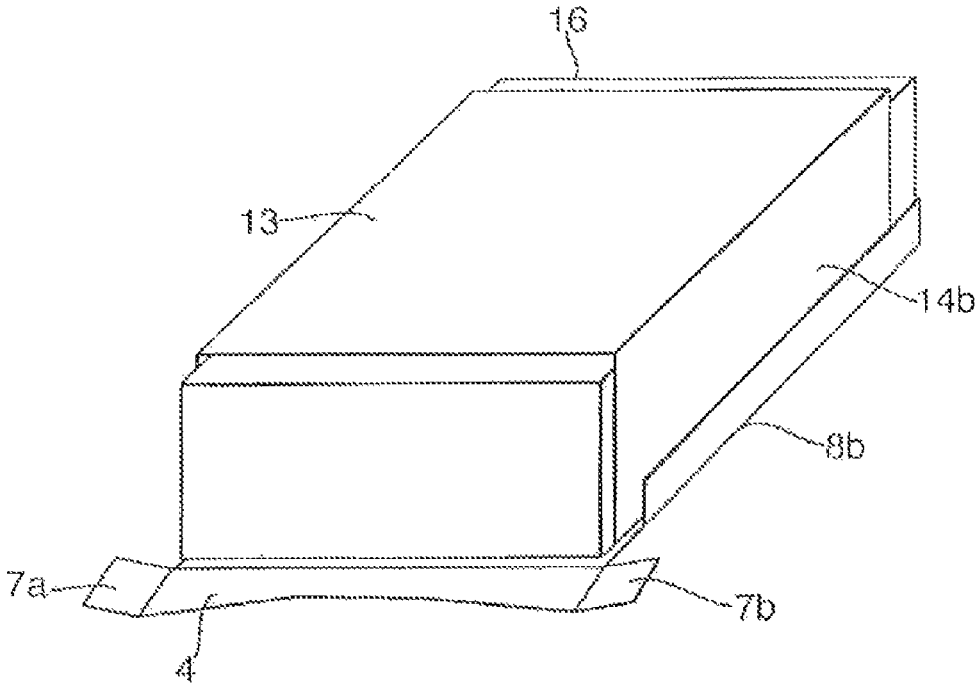
Figure 4:
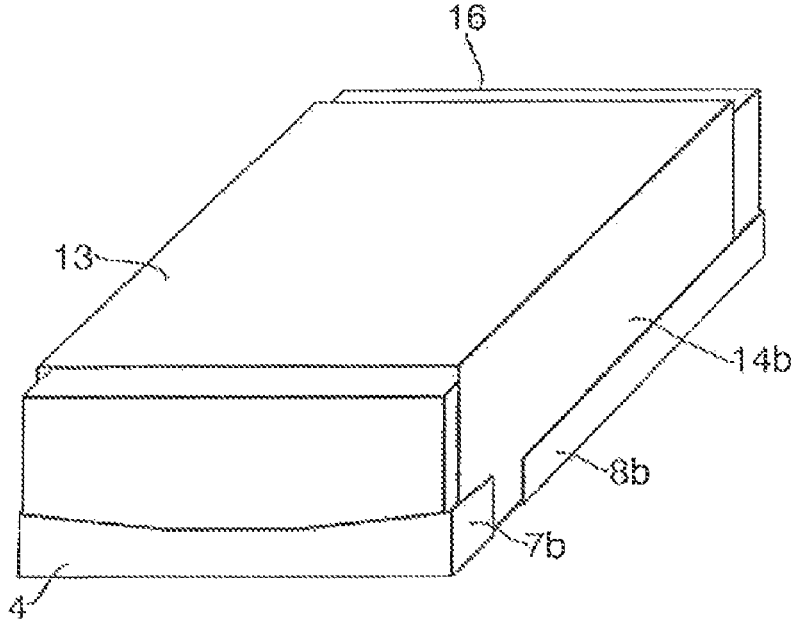

The invention will now be described by reference to the following non limiting figures, in which:

FIGS. 1*a* and 1*b* are plan views of a sheet of material used to form the base and lid of a box of the present invention:

FIGS. 2 to 4 are perspective views of a partially assembled/fully assembled box of the present invention.

From FIGS. 1*a* and 1*b* can be seen that the box 1 comprises a base section 2 and a hood 3.

The base section 2 is formed from a sheet of material (e.g. cardboard) the base section 2 has a removal retaining wall 4 created by folding about a line 5. Line 5 is then cut along the majority of its length leaving two attachment points 6*a* and 6*b*. The retaining wall 4 has two edge flaps 7*a* and 7*b* for attachment to the hood 3.

A non-removable retaining wall 8 is created by folding about lines 9, 10 and 11. The individual wall sections 8*a*, 8*b* and 8*c* are retained position by being adjoined through flaps 12*a* and 12*b*.

The hood 3 is similarly formed from a sheet of material (e.g. cardboard).

The hood 3 comprises a planar section 13 and two dependent curtains 14*a* and 14*b* formed by folding along lines 15*a* and 15*b* respectively.

From FIGS. 2 to 4 it can be seen how the box 1 is assembled. In FIG. 2 the hood 3 is offered to the base section 2, wherein the base section 2 contains a plurality of primary packages 16.

In FIG. 3 the hood 3 is seated on the primary packages 16.

In FIG. 4 the removable retaining wall 4 is folded about line 5, the edge flaps 7*a* and 7*b* are folded inwards and adhered (e.g. by gluing) to the curtains 14*a* and 14*b*.

When the hood 3 is removed from the base section 2 the removable retaining wall 4 because of its attachment to the hood 3 is removed simultaneously.

The invention claimed is:

1. A packaging and display box adapted for retaining at least one primary package, the box comprising a base and a lid, the base having a retaining wall adjacent a section of its perimeter for retaining the at least one primary package and further having a removable perimeter wall having two edge flaps attached to the lid wherein the lid is adapted to be separated from the base along a cut line and the removable perimeter wall is attached to the base only by two attachment points at the ends of the cut line, and wherein the lid extends between two portions of the base, the lid covering at least a part of the at least one primary package, and wherein the lid is attached to the removable perimeter wall such that removal of the lid from the base causes detachment of the removable perimeter wall from the base.

2. A packaging and display box according to claim 1, wherein the retaining wall adjacent to a section of the perimeter of the base is not removed from the base.

3. A packaging and display box according to claim 1, wherein the base of the box is formed from a sheet of material such as a sheet of card, thickened paper or cardboard.

4. A packaging and display box according to claim 3, wherein the retaining wall is formed by folding an edge of the sheet inwards.

5. A packaging and display box according to claim 1, wherein the removable perimeter wall is attached to the lid by a flap extending from said removable perimeter wall.

6. A packaging and display box according to claim 5, wherein the flap is glued to the lid.

7. A packaging and display box according to claim 1, wherein the box contains a plurality of primary packages.

8. A packaging and display box adapted to contain at least one primary package, the said box comprising a lid and a base having a plurality of edges defining a perimeter, said perimeter comprising a retained perimeter wall extending about a part of the base, and a removable perimeter wall extending about a different part of the base, wherein a part of the removable perimeter wall is separated from the base by a cut line therebetween and the removable perimeter wall is only attached to the base section by two or more attachment points, and wherein the removable perimeter wall is attached to the lid, wherein the lid which extends between two portions of the base and covers at least a part of the primary package, such that separation of the lid from the packaging and display box causes detachment of the removable perimeter wall from the base only at the attachment points.

9. A packaging and display box according to claim 8, wherein the removable perimeter wall is directly attached to a portion of the lid.

10. A packaging and display box according to claim 8, wherein the removable perimeter wall is attached to the lid by one or more flaps extending from the removable perimeter wall.

11. A packaging and display box according to claim 10 wherein the one or more flaps extending from the removable perimeter wall attached to the lid and which are spaced part from the retained perimeter wall when the lid and base are assembled to retain a primary package.

12. A packaging and display box according to claim 1, wherein the removable perimeter wall is attached to the lid and is spaced part from the retained perimeter wall when the lid and base are assembled to retain a primary package.

13. A packaging and display box according to claim 12, wherein the removable perimeter wall further comprises one or more flaps depending from the removable perimeter wall which are separated from the base, which flaps are attached to the lid, and which are spaced part from the retained perimeter wall when the lid and base are assembled to retain a primary package.

* * * * *